US009879395B2

(12) United States Patent
Foo

(10) Patent No.: US 9,879,395 B2
(45) Date of Patent: Jan. 30, 2018

(54) VERSATILE MULTIPURPOSE JACKUP UNIT

(71) Applicant: Keppel Offshore and Marine Technology Centre, Singapore (SG)

(72) Inventor: Kok Seng Foo, Singapore (SG)

(73) Assignee: Keppel Offshore and Marine Technology Centre, Singapore (SG)

( * ) Notice: Subject to any disclaimer, the term of this patent is extended or adjusted under 35 U.S.C. 154(b) by 35 days.

(21) Appl. No.: 14/976,163

(22) Filed: Dec. 21, 2015

(65) Prior Publication Data

US 2016/0177526 A1 Jun. 23, 2016

Related U.S. Application Data

(60) Provisional application No. 62/096,163, filed on Dec. 23, 2014.

(51) Int. Cl.
*E02B 17/00* (2006.01)
*E02B 17/02* (2006.01)

(52) U.S. Cl.
CPC ..... *E02B 17/021* (2013.01)

(58) Field of Classification Search
CPC ..... E02B 15/003; E02B 17/00; E02B 17/021
See application file for complete search history.

(56) References Cited

U.S. PATENT DOCUMENTS 3,477,235 A * 11/1969 Hester, Jr. ..... E02B 17/00 175/5
4,081,932 A * 4/1978 Armstrong ..... B66C 23/52 173/28
4,483,644 A * 11/1984 Johnson ..... E02B 17/021 175/9
6,729,804 B1 * 5/2004 Roodenburg ..... B63B 35/44 175/5
8,851,797 B1 * 10/2014 Foo ..... E21B 15/003 405/201
8,926,224 B2 * 1/2015 Seng ..... E21B 15/003 405/201
9,260,920 B2 * 2/2016 Seng ..... E21B 7/12
2004/0151549 A1 * 8/2004 Roodenburg ..... E02B 17/021 405/201
2008/0044234 A1 * 2/2008 Morrison ..... E02B 17/0004 405/201
2010/0260555 A1 * 10/2010 Foo ..... E21B 15/003 405/201
2012/0224925 A1 * 9/2012 Roper ..... E02B 17/00 405/201

* cited by examiner

*Primary Examiner* — Benjamin F Fiorello
(74) *Attorney, Agent, or Firm* — Duane Morris LLP

(57) ABSTRACT

A versatile multipurpose jackup unit comprises a hull with a top platform; and a configurable and detachable cantilever installation system comprising a plurality of longitudinal working groups; wherein each longitudinal working group comprises a stern pad, and more than one fixed cantilever hold-down modules.

18 Claims, 19 Drawing Sheets

VERSATILE MULTIPURPOSE JACKUP UNIT

CROSS REFERENCE

This application is a non-provisional application of and claims priority benefit of provisional application No. 62/096,163 entitled VERSATILE MULTIPURPOSE JACKUP UNIT filed 23 Dec. 2014, the entirety of which is incorporated herein by reference.

FIELD OF THE SUBJECT MATTER

The present subject matter relates generally to an offshore jackup rig and more particularly to a versatile multipurpose jackup unit comprising a configurable cantilever installation system that is flexible for installing detachable cantilevers with different sizes and types.

BACKGROUND

Offshore jackup rigs have been widely employed in offshore exploration for oil or gas. The jackup rigs usually comprise a jackup unit (JU) including a hull with a top platform for providing a working area and accommodating various working instruments. One common instrument employed on the top platform of a JU in an offshore jackup rig is cantilever.

In the current operation of a cantilever, only one stern pad and one hold-down claw are used for one beam of a cantilever. The hold-down claw used is a fixed type, meaning that the hold-down claws are welded to a fixed claw body being permanently installed onto the top platform of the hull of a jackup rig; thus, the hold-down claws can take the uplift load from the cantilever. Since the hold-down claws are permanently installed, it can only be removed by a destructive way such as cutting.

In the offshore exploration, jackup rigs have been employed for many purposes including drilling, accommodation, decommissioning, well intervention, and plug and abandonment (P&A). A rig capable of serving all the purposes with optimized cantilever outreach, load capacity and main deck space is always preferred. However, the optimized rig main deck arrangement and cantilever capacity are always different for different purposes. The characteristics of the fixed hold-down claws postulate a limit on the sizes and types of the cantilevers that can be installed. Furthermore, the fixed hold-down claws restrict the maximum extension of a given cantilever. There is no way to change a different type of cantilever or a cantilever with a different size without incurring major modifications of a rig.

Therefore, there is an imperative need to develop a JU that is so versatile that different types of cantilevers with different sizes can be flexibly chosen according to the different serving purposes. The installed cantilever maximum outreach for the serving purpose can be further improved when less load capacity is required; or the cantilever maximum load capacity can be further improved when less outreach is necessary.

SUMMARY

The present subject matter provides a fixed cantilever hold-down module and detachable passive hold-down device being employed in a jackup unit. In one embodiment, the fixed cantilever hold-down module and detachable passive hold-down device comprise a fixed cantilever hold-down module with an E-shaped configuration; wherein the fixed cantilever hold-down module has a cantilever support surface, two end supports and a middle bridge for supporting the cantilever support surface, two pairs of upward cantilever guiding protrusions of which each is disposed at one corner of the fixed cantilever hold-down module, a plurality of locking pins, and a plurality of locking pin receiving holes located at the two end supports and middle bridge for receiving the locking pins; and a detachable hold-down device having a recess formed at the center of its inner surface so as to form at least one upper engaging surface and a locking pin receiving hole located at its bottom half for receiving the locking pins; so that when the fixed cantilever hold-down module and detachable passive hold-down device are assembled, the detachable passive hold-down device can pivotedly rotate between a horizontal (disengaged) position to a vertical (engaged) position.

In another embodiment of the fixed cantilever hold-down module and detachable passive hold-down device, the locking pins are two pairs, and each side of the two end supports and middle bridge has one locking pin receiving hole for receiving one locking pin.

The present subject matter also provides a versatile multipurpose jackup unit. In one embodiment, the versatile multipurpose jackup unit comprises a hull with a top platform; and a configurable and detachable cantilever installation system comprising a plurality of longitudinal working groups; wherein each longitudinal working group comprises a stern pad, and more than one fixed cantilever hold-down modules; wherein the stern pad is disposed at a transverse position along the transom of the top platform so that the stern pad, and fixed cantilever hold-down modules are sequentially aligned to form the longitudinal working group; and wherein each working groups is capable of accommodating one beam of a cantilever and a plurality of detachable passive hold-down devices; wherein each detachable passive hold-down device is coupled with one fixed cantilever hold-down module in one longitudinal working group when the fixed cantilever hold-down modules and detachable passive hold-down devices are engaged with a cantilever.

In one embodiment, the versatile multipurpose jackup unit further comprises a plurality of longitudinal skidding foundations for the skidding of the beam of cantilever, wherein each of plurality of the longitudinal skidding foundations is disposed between the stern pad and fixed cantilever hold-down modules in the longitudinal working group.

In another embodiment of the versatile multipurpose jackup unit, the more than one fixed cantilever hold-down modules comprises at least one AFT fixed cantilever hold-down module, and at least one FWD fixed cantilever hold-down module.

In another embodiment of the versatile multipurpose jackup unit, the stem pad has a main body, and two side flanges; wherein the bottom of the main body is permanently welded onto the top platform; wherein the main body has a top surface for bearing a compression load; and wherein the two side flanges are positioned on the two opposite sides in the main body and built close to the top surface so as to guide a cantilever skidding beam.

In another embodiment of the versatile multipurpose jackup unit, the fixed cantilever hold-down module comprises a hold-down body and two side stoppers that are coupled to the two ends of the hold-down body; wherein the hold-down body and two side stoppers are permanently fixed onto the top platform; and wherein the hold-down body has an engaging lip at its upper portion; and wherein the detachable passive hold-down device has a U-shaped recess formed at the center of its inner surface so as to form an upper engaging surface and a lower engaging surface; so that when two of the detachable passive hold-down devices are engaged with the hold-down body, the lower engaging surface is in contact with the engaging lip and the upper engaging surface with the upper surface of a cantilever skidding beam when the detachable passive hold-down devices are installed.

In another embodiment of the versatile multipurpose jackup unit, the fixed cantilever hold-down module has an E-shaped configuration; wherein the fixed cantilever hold-down module has a cantilever support surface, two end supports and a middle bridge for supporting the cantilever support surface, two pairs of upward cantilever guiding protrusions of which each is disposed at one corner of the fixed cantilever hold-down module, a plurality of locking pins, and a plurality of locking pin receiving holes located at the two end supports and middle bridge for receiving the locking pins; and the detachable hold-down device having a recess formed at the center of its inner surface so as to form at least one upper engaging surface and a locking pin receiving hole located at its bottom half for receiving the locking pins; so that when the fixed cantilever hold-down module and detachable passive hold-down device are assembled, the detachable passive hold-down device can pivotedly rotate between a horizontal (disengaged) position to a vertical (engaged) position.

In another embodiment of the versatile multipurpose jackup unit, the locking pins are two pairs, and each side of the two end supports and middle bridge has one locking pin receiving hole for receiving one locking pin.

The objectives and advantages of the claimed subject matter will become apparent from the following detailed description of preferred embodiments thereof in connection with the accompanying drawings.

BRIEF DESCRIPTION OF THE DRAWINGS

Preferred embodiments according to the present subject matter will now be described with reference to the Figures, in which like reference numerals denote like elements.

DETAILED DESCRIPTION

The present subject matter may be understood more readily by reference to the following detailed description of certain embodiments of the subject matter.

Throughout this application, where publications are referenced, the disclosures of these publications are hereby incorporated by reference, in their entireties, into this application in order to more fully describe the state of art to which this subject matter pertains.

Figure 1:
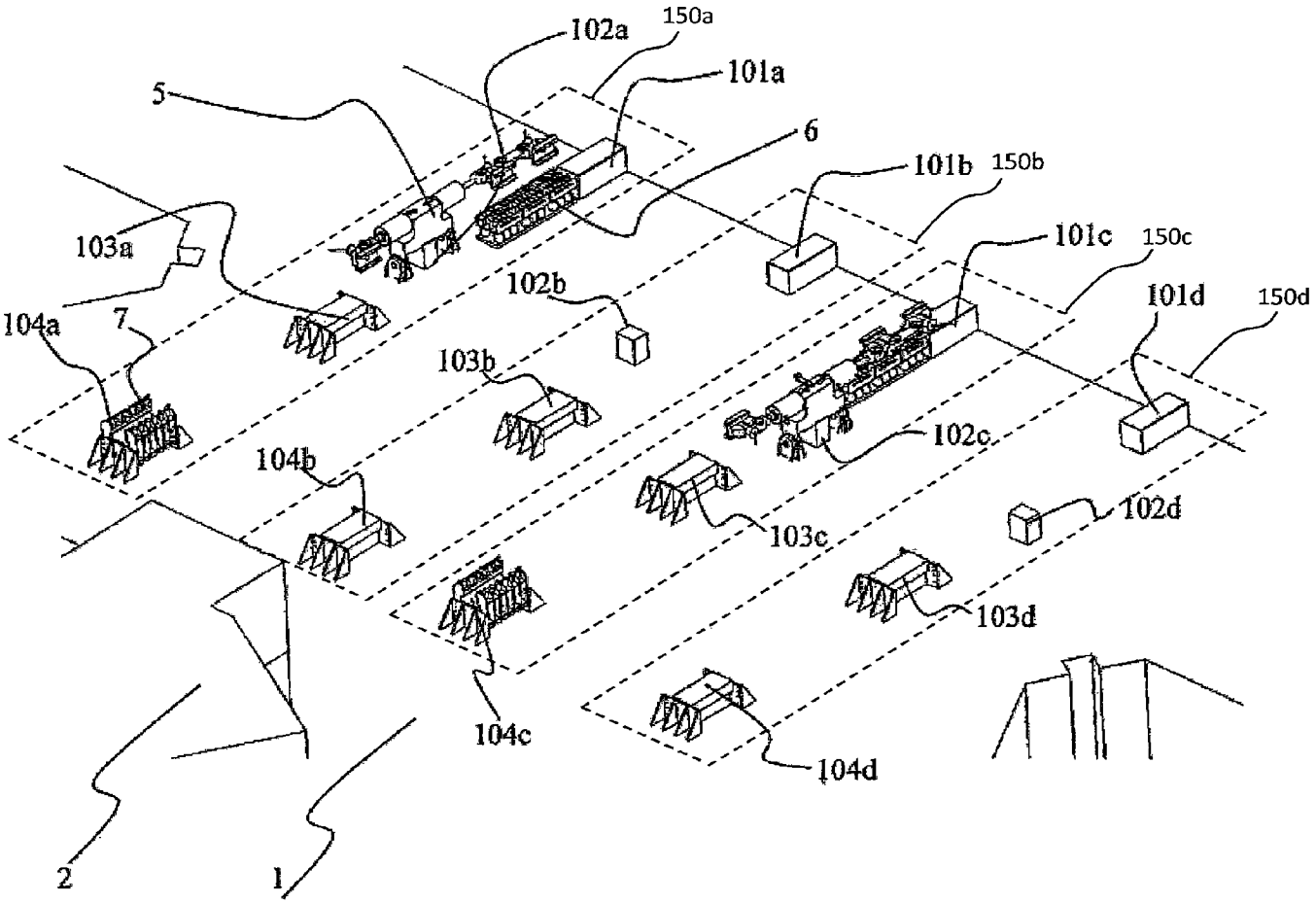
FIG. 1 shows a plan view of the versatile multipurpose JU in accordance with one embodiment of the present subject matter.

Referring now to FIG. 1, there is provided a plan view of the versatile multipurpose JU in accordance with one embodiment of the present subject matter. The JU 100 comprises a hull with a top platform 1 for providing a working area for accommodating accessories 2 disposed upon the top platform, and a configurable and detachable cantilever installation system disposed onto the top platform 1. In principle, the configurable and detachable cantilever installation system comprises a plurality of fixed cantilever hold-down modules and detachable passive hold-down devices. ("Passive" means that the detachable claws have to be engaged to hold the cantilever. If more than one pairs of detachable claws are engaged along one longitudinal working group, the cantilever will "select" the pair of detachable claws to take the full load-it would always be the pairs close to the stern) where the fixed cantilever hold-down modules together with other elements can be configured to form a plurality of longitudinal working groups of which each comprises more than one fixed cantilever hold-down modules. It is to be noted that the number of the longitudinal working groups and the number of the fixed cantilever hold-down modules in each working group are variable and completely dependent upon application requirements Referring still to FIG. 1, the configurable and detachable cantilever installation system comprises a plurality of stern pads 101*a*, 101*b*, 101*c*, 101*d*, a plurality of longitudinal skidding foundations 102*a*, 102*b*, 102*c*, 102*d*, a plurality of AFT fixed cantilever hold-down modules 103*a*, 103*b*, 103*c*, 103*d*, and a plurality of FWD fixed cantilever hold-down modules 104*a*, 104*b*, 104*c*, 104*d*. The plurality of stern pads 101*a*, 101*b*, 101*c*, 101*d* are disposed at different transverse positions along the transom of the top platform 1, where the plurality of longitudinal skidding foundations 102*a*, 102*b*, 102*c*, 102*d*, the plurality of AFT fixed cantilever hold-down modules 103*a*, 103*b*, 103*c*, 103*d*, and the plurality of FWD fixed cantilever hold-down modules 104*a*, 104*b*, 104*c*, 104*d* are also disposed on the top platform 1 in such a manner that one stern pad (e.g., 101*a*), one longitudinal skidding foundation (e.g., 102*a*), one AFT fixed cantilever hold-down module (103*a*) and one FWD fixed cantilever hold-down module (e.g., 104*a*) form one longitudinal working group 150*a*, 150*b*, 150*c*, 150*d*. Each working group (150*a-d*) is capable of accommodating one beam of a cantilever. While four longitudinal working groups are shown in FIG. 1, different number of the working groups (3 or more) may be present depending on application requirements. Furthermore, each working group can have 2 or more cantilever hold-down modules (e.g. 103', 104'), and different working groups can have different number of cantilever hold-own modules. In addition, the longitudinal skidding foundations 102 in each working group can be optional. In one embodiment, the longitudinal skidding foundations 102 in each working group are incorporated into the stern pads 101 so that the stern pad 101 can be used for skidding if needed. In another embodiment, the longitudinal skidding foundations 102*a*, 102*b*, 102*c*, 102*d* in each working group are incorporated into the AFT fixed cantilever hold-down modules 103 so that the AFT fixed cantilever hold-down modules 103 can be used for skidding if needed.

Referring still to FIG. 1, the configurable and detachable cantilever installation system further comprises a plurality of detachable passive hold-down devices 7, where the detachable passive hold-down devices 7 will only be installed to the fixed cantilever hold-down modules 103, 104 that are being used for holding-down cantilevers according to the need of cantilever skidding and operation load capacity. The detachable passive hold-down devices 7 can be detached and put into storage when the cantilever is not installed; thus the versatile multipurpose JU can work as an accommodation unit with maximum accommodation and storage capacity.

Referring still to FIG. 1, the configurable and detachable cantilever installation system further comprises the two pair of longitudinal skidding systems 5 and rollers 6 that will be employed during the installation of a cantilever. The longitudinal skidding systems 5 and rollers 6 are well known in the art; no details for them will be described herein in order not to obscure this subject matter.

Figure 2:
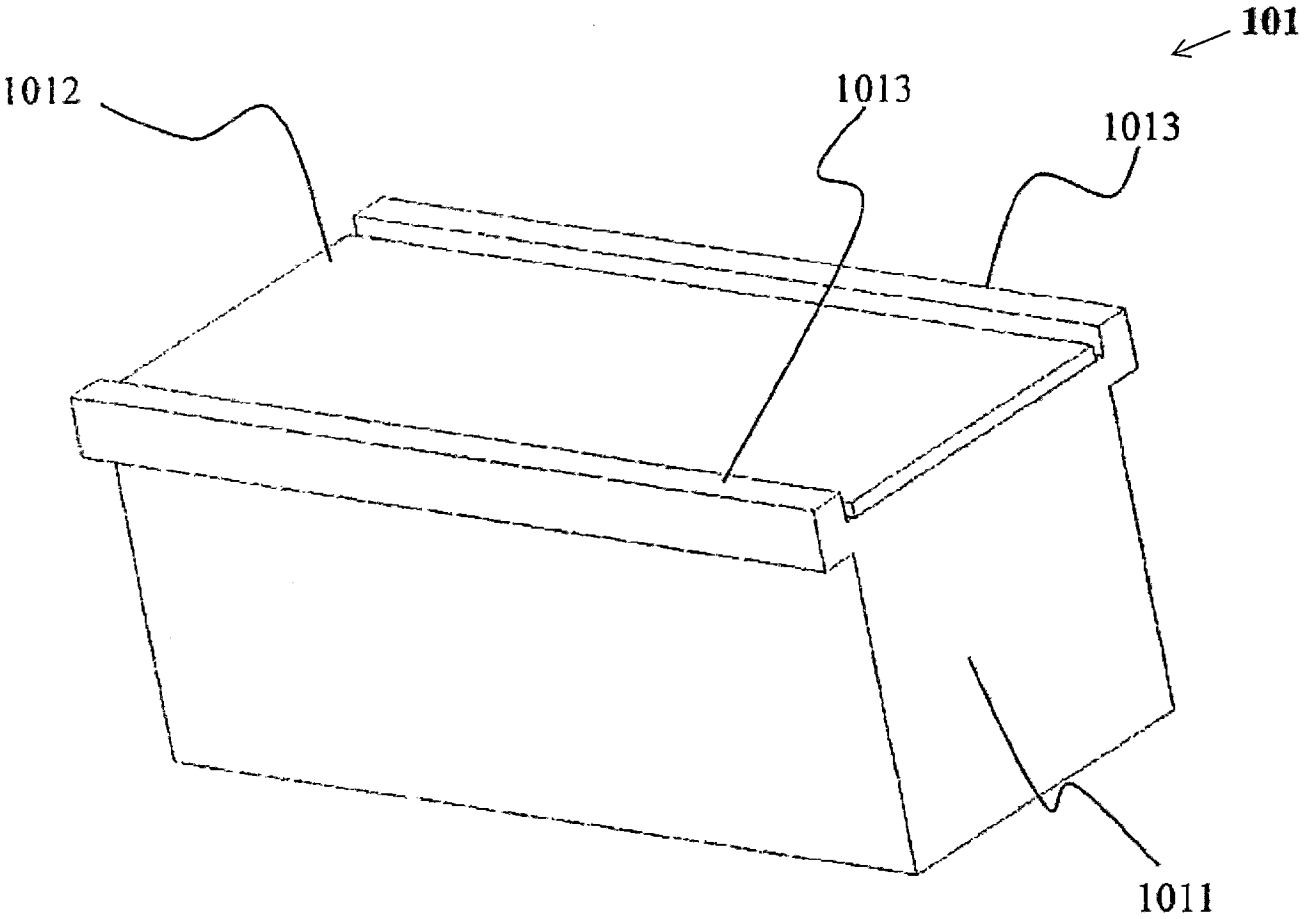
FIG. 2 shows an isometric view of the stern pad in accordance with one embodiment of the present subject matter.

Referring now to FIG. 2, there is provided an isometric view of the stern pad 101 in accordance with one embodiment of the present subject matter. The stern pad 101 is the main compression load bearing component supporting an installed cantilever during drilling or other operations. As shown in FIG. 2, the stern pad 101 has a main body 1011, and two side flanges 1013. The bottom of the main body 1011 is permanently welded onto the top platform of the hull close to transom area. The main body has a top surface 1012 functioning as a compression load bearing surface that will be in contact with the bottom surface of a cantilever skidding beam. The two side flanges 1013 are positioned on the two opposite sides in the main body 1011 and built close to the top surface 1012 so as to guide the cantilever skidding beam and prevent it from dropping off the stern pad 101. The two side flanges 1013 have an upright configuration so that the cantilever can be installed or removed from above directly. In certain embodiments, the stern pad 101 could be used for skidding if needed.

The longitudinal skidding foundation 102 is used to support the longitudinal skidding systems 5 and take the shear load induced during skidding. In one embodiment, the longitudinal skidding foundation 102 can be a box-shaped structure.

Figure 3:
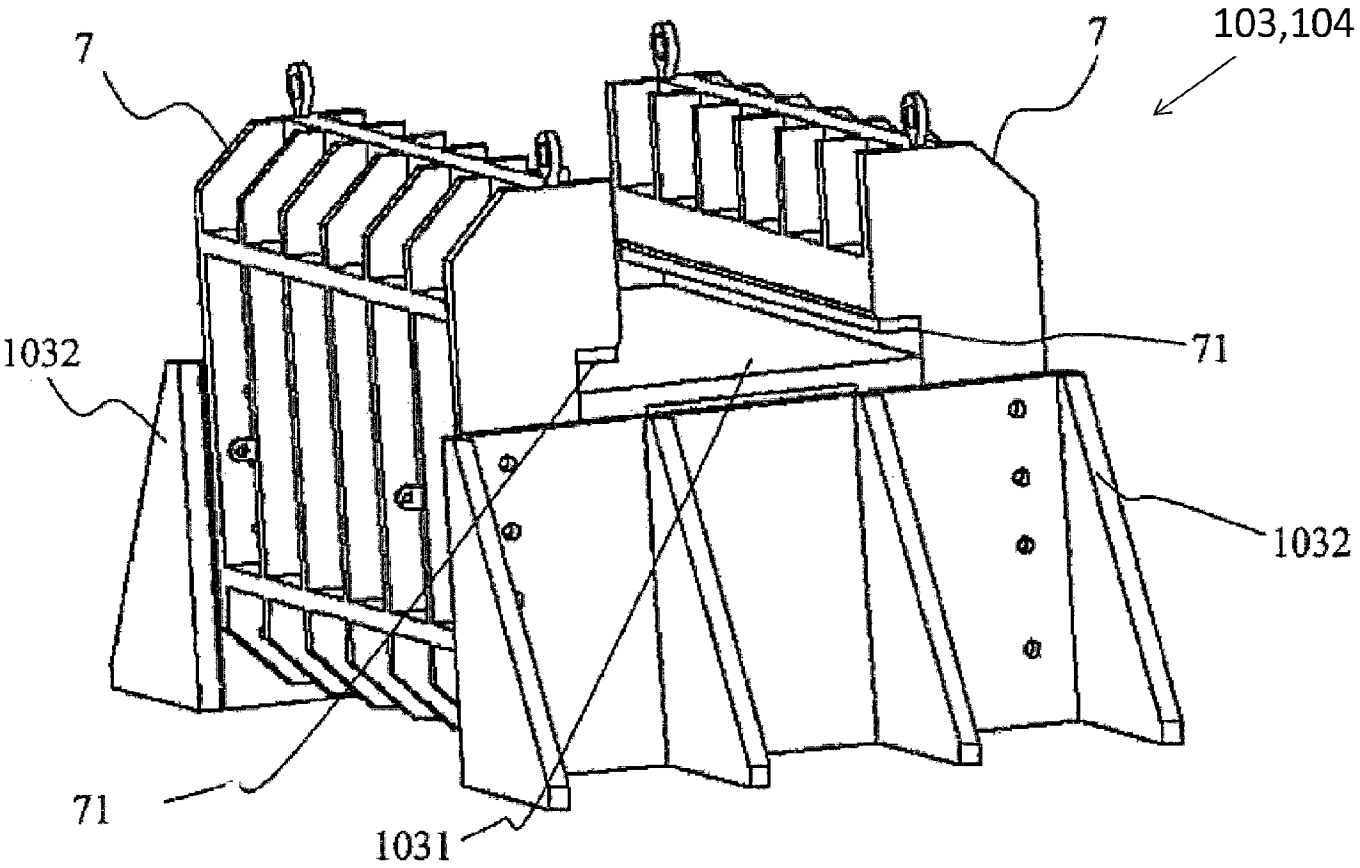
FIGS. 3 and 4 show respective isometric views of an assembled or dissembled fixed cantilever hold-down modules and detachable passive hold-down devices in accordance with one embodiment of the present subject matter.
Figure 4:
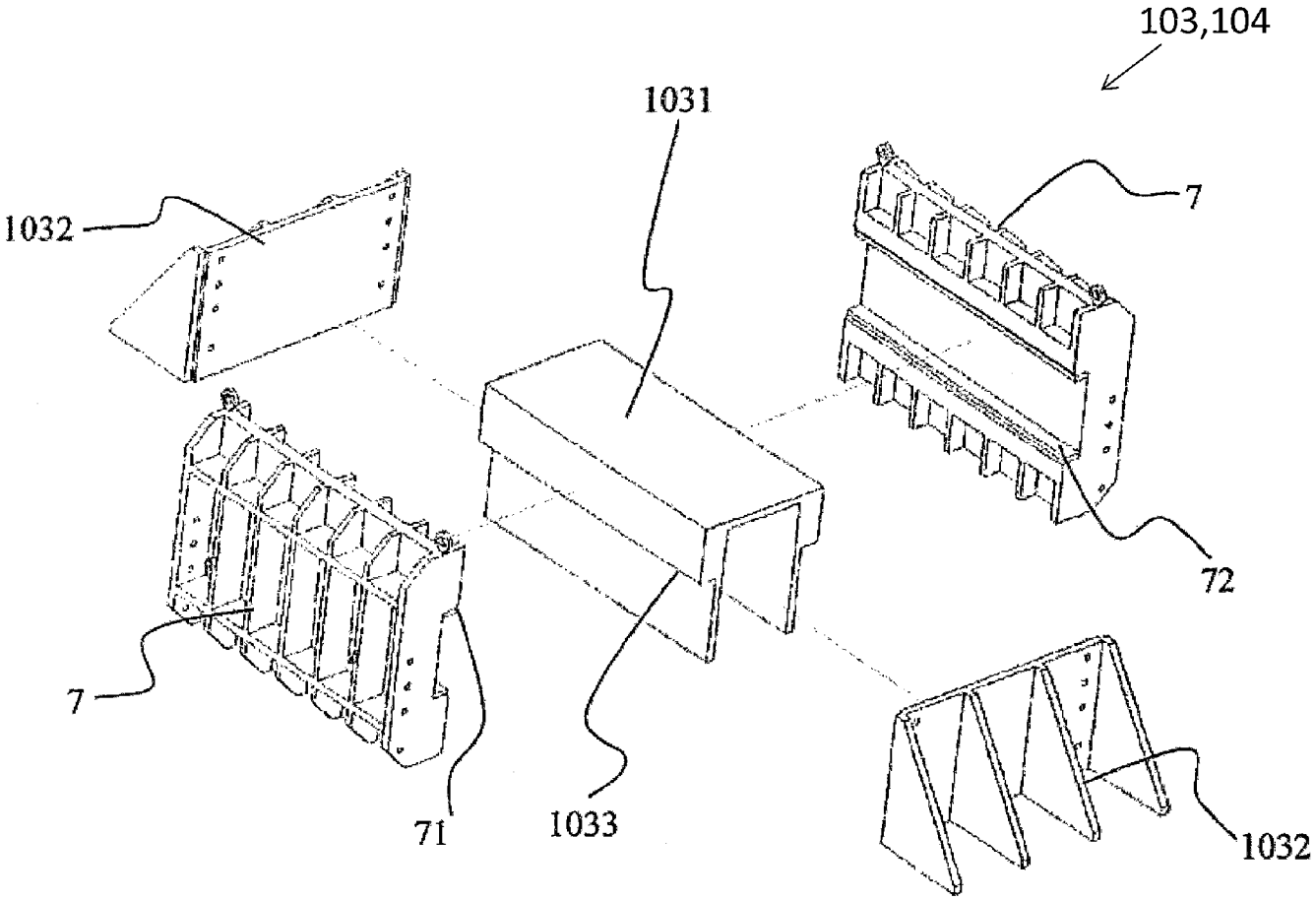

Referring now to FIGS. 3 and 4, there are provided respective isometric views of an assembled or dissembled fixed cantilever hold-down modules and detachable passive hold-down devices in accordance with one embodiment of the present subject matter. As shown in FIGS. 3 and 4, the fixed cantilever hold-down module 103, 104 comprises a hold-down body 1031 and two side stoppers 1032 that are coupled to the two ends of the hold-down body 1031. The hold-down body 1031 and two side stoppers 1032 are permanently fixed onto the top platform of the JU by, for example, welding. The hold-down body 1031 has an engaging lip 1033 at its upper portion. The detachable passive hold-down device 7 has a U-shaped recess formed at the center of its inner surface so as to form an upper engaging surface 71 and a lower engaging surface 72. When two detachable passive hold-down devices 7 are engaged with the hold-down body 1031, the lower engaging surface 72 is in contact with the engaging lip 1033 and the upper engaging surface 71 with the upper surface of a cantilever skidding beam when the detachable passive hold-down devices are installed. By doing this, the detachable hold-down devices 7 are able to take the uplift load from an extended cantilever. The detachable passive hold-down devices 7 will be fastened with the side stoppers 1032 after its lower engaging surface 72 and upper engaging surface 71 are properly engaged with the engaging lip 1033 and cantilever skidding beam respectively. The upper surface of the hold-down body 1031 will be supporting the cantilever while the center of gravity (CG) of the cantilever is in between the stern pad and fixed cantilever hold-down module with the detachable passive hold-down device engaged (wearing plate/rollers could be put in between to reduce the friction). To install the cantilever, the detachable passive hold-down devices 7 shall first be removed. Then, the cantilever can be lifted and put down with the bottom surface of a skidding beam in contact with stern pad load bearing surface 1012 and hold-down body 1031. Once the cantilever is located properly, the detachable passive hold-down devices 7 can be engaged properly with the hold-down body 1031 in order to achieve the required maximum longitudinal skidding distance and load capacity.

Figure 5:
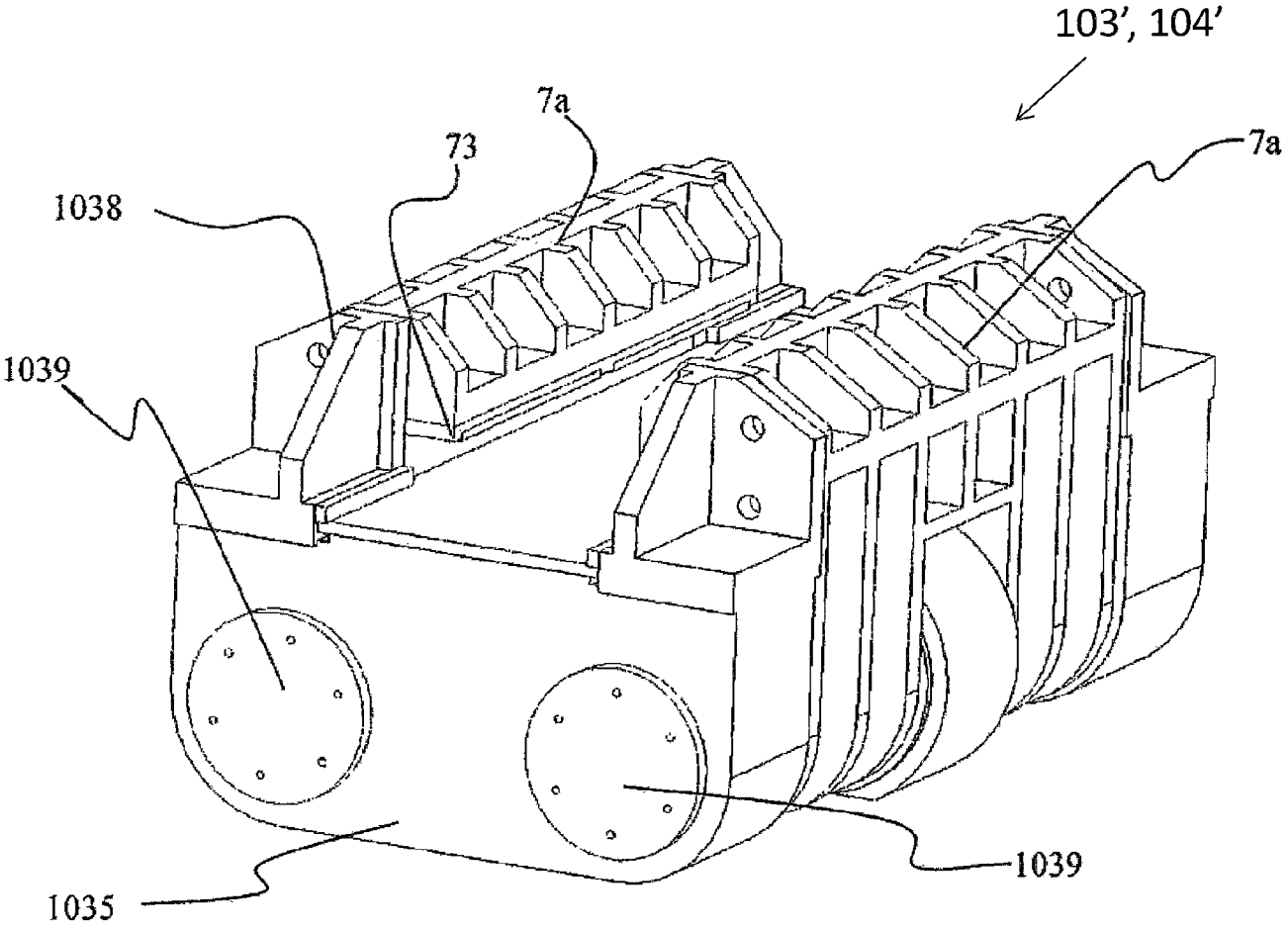
FIGS. 5 and 6 show respective isometric views of an assembled or dissembled fixed cantilever hold-down modules and detachable passive hold-down devices in accordance with another embodiment of the present subject matter.
Figure 6:
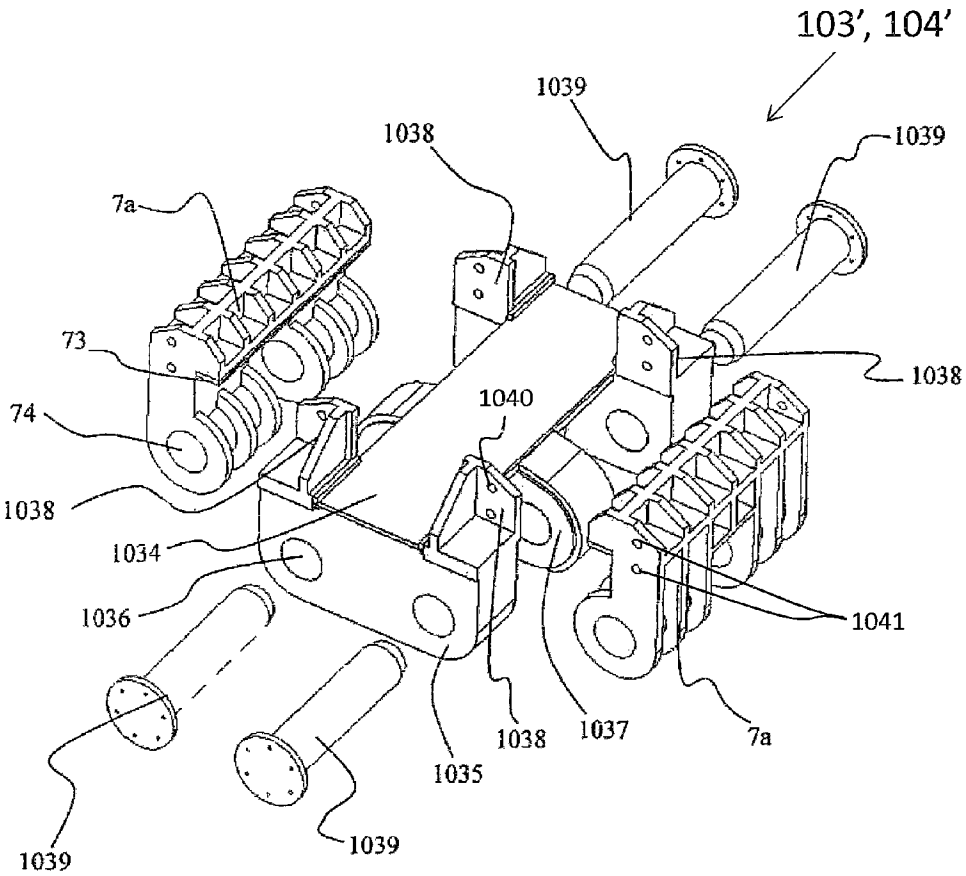
Figure 7:
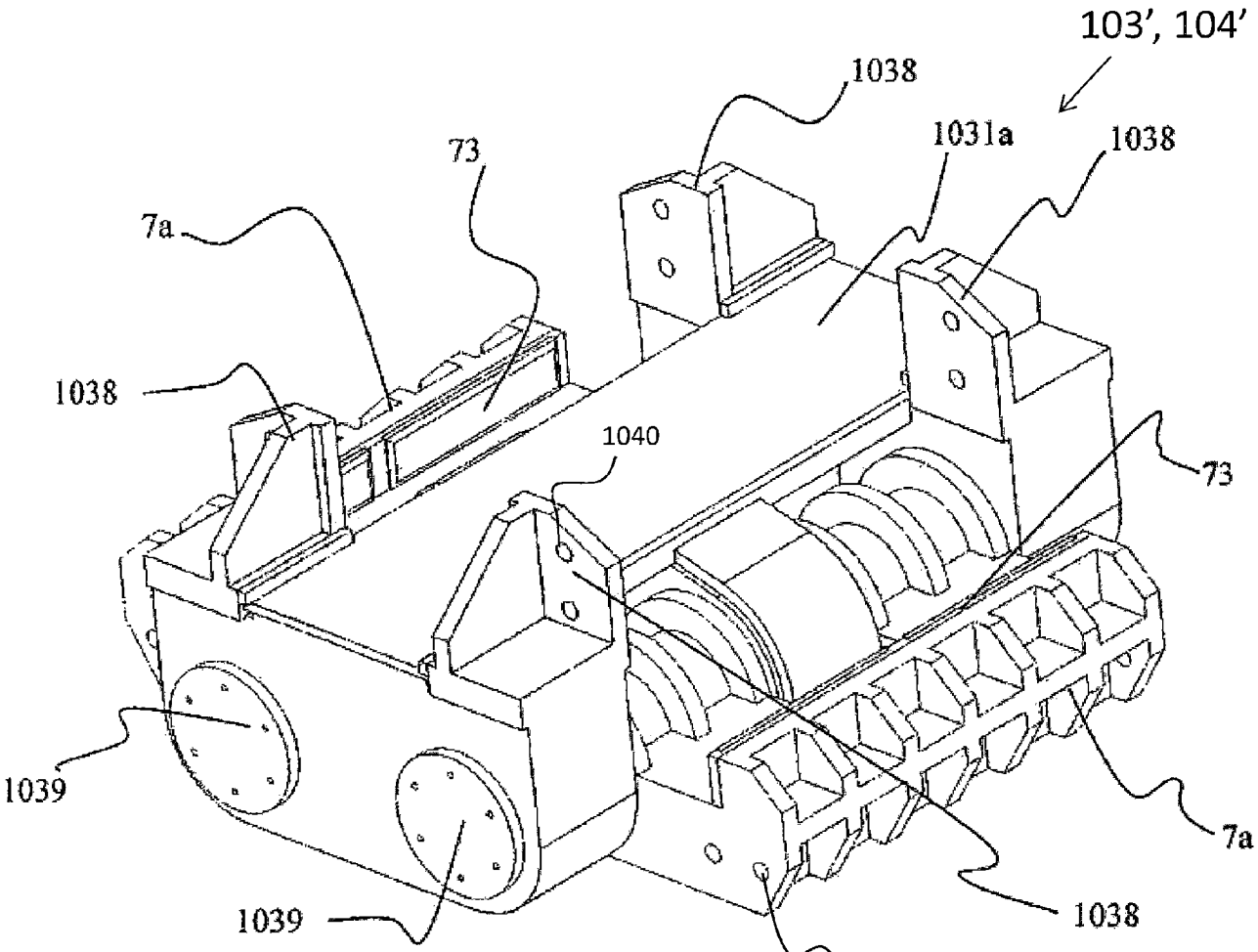
FIG. 7 shows an isometric view of the detachable passive hold-down devices open up to a horizontal (disengaged) position.

Referring now to FIGS. 5 and 6, there are provided respective isometric views of an assembled or dissembled fixed cantilever hold-down modules and detachable passive hold-down devices in accordance with another embodiment of the present subject matter. As shown in FIGS. 5 and 6, the fixed cantilever hold-down module 103', 104' is an E-shaped structure having a cantilever support surface 1034, two end supports 1035 and a middle bridge 1037 for supporting the cantilever support surface 1034, two pairs of upward cantilever guiding protrusions 1038 of which each is disposed at one corner of the fixed cantilever hold-down module 103', 104', two pairs of locking pins 1039, and two locking pin receiving holes 1036 located at each side of the two end supports 1035 and middle bridge 1037 for receiving the locking pins 1039. The detachable hold-down device 7*a* has a recess formed at the center of its inner surface so as to form at least one upper engaging surface 73 and a locking pin receiving hole 74 located at its bottom half for receiving the locking pins 1039. This embodiment allows the detachable passive hold-down devices 7 to pivotedly rotate between a horizontal (disengaged) position (as shown in FIG. 7) to a vertical (engaged) position (as shown in FIG. 5). The fixed cantilever hold-down modules 103', 104' are permanently fixed onto the top platform of the JU by for example welding. As shown in FIG. 5, the detachable passive hold-down devices 7*a* are pinned to the fixed cantilever hold-down module 103', 104' by the locking pins 1039 on each side through locking pin receiving holes 1036. Plain/roller bearings can be installed in between the pin and holes to reduce the friction during pivoting of the detachable passive hold-down device 7*a*. The upward cantilever guiding protrusions 1036 have holes 1040 which align with holes 1041 in the detachable hold down device 7*a* when in the engaged position. A retaining pin/bolt/key (not shown) prevents the rotation of the detectable hold down device from the engaged position, without taking the load of the cantilever. The retaining pin/bolt/key may be selected from common bolts, keys, rods, rivets, screws, clips, hitch pins, lynch pins, safety pins and cotter pins.

FIG. 7 shows that the detachable passive hold-down devices 7*a* are open up to a horizontal (disengaged) position so that a cantilever can be installed or removed.

Figure 8:
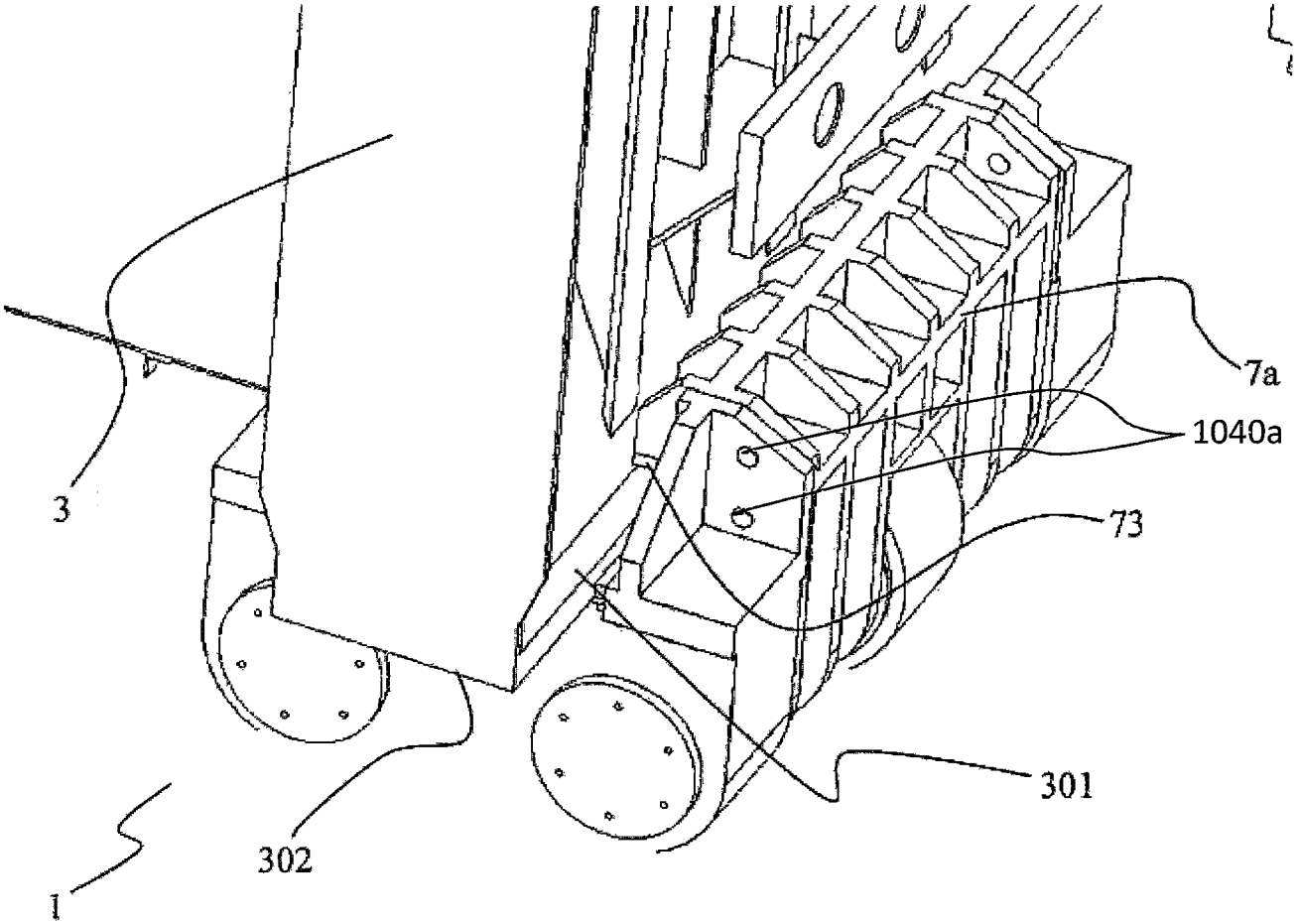
FIG. 8 is an isometric view showing that the fixed cantilever hold-down module and detachable passive hold-down devices are engaged with a cantilever.

FIG. 8 shows that the fixed cantilever hold-down module 103', 104' and detachable passive hold-down device 7*a* are engaged with a cantilever 3. The upper engaging surface 73 of the detachable passive hold-down device 7*a* is in contact with the upper surface of the cantilever skidding beam 301 so that the uplifting load of the cantilever can be transferred to the detachable passive hold-down device 7*a* and then, passed down to the fixed cantilever hold-down module 103', 104'. Pivoting the detachable passive hold-down device 7*a* to a horizontal position will disengage the upper engaging surface 73 of the detachable passive hold-down device 7*a* from the upper surface of the cantilever skidding beam 301, so that the cantilever can be released. The bottom surface 302 of the cantilever skidding beam always rests on the cantilever support surface 1034 of the fixed cantilever hold-down module unless the cantilever 3 is removed.

Figure 9:
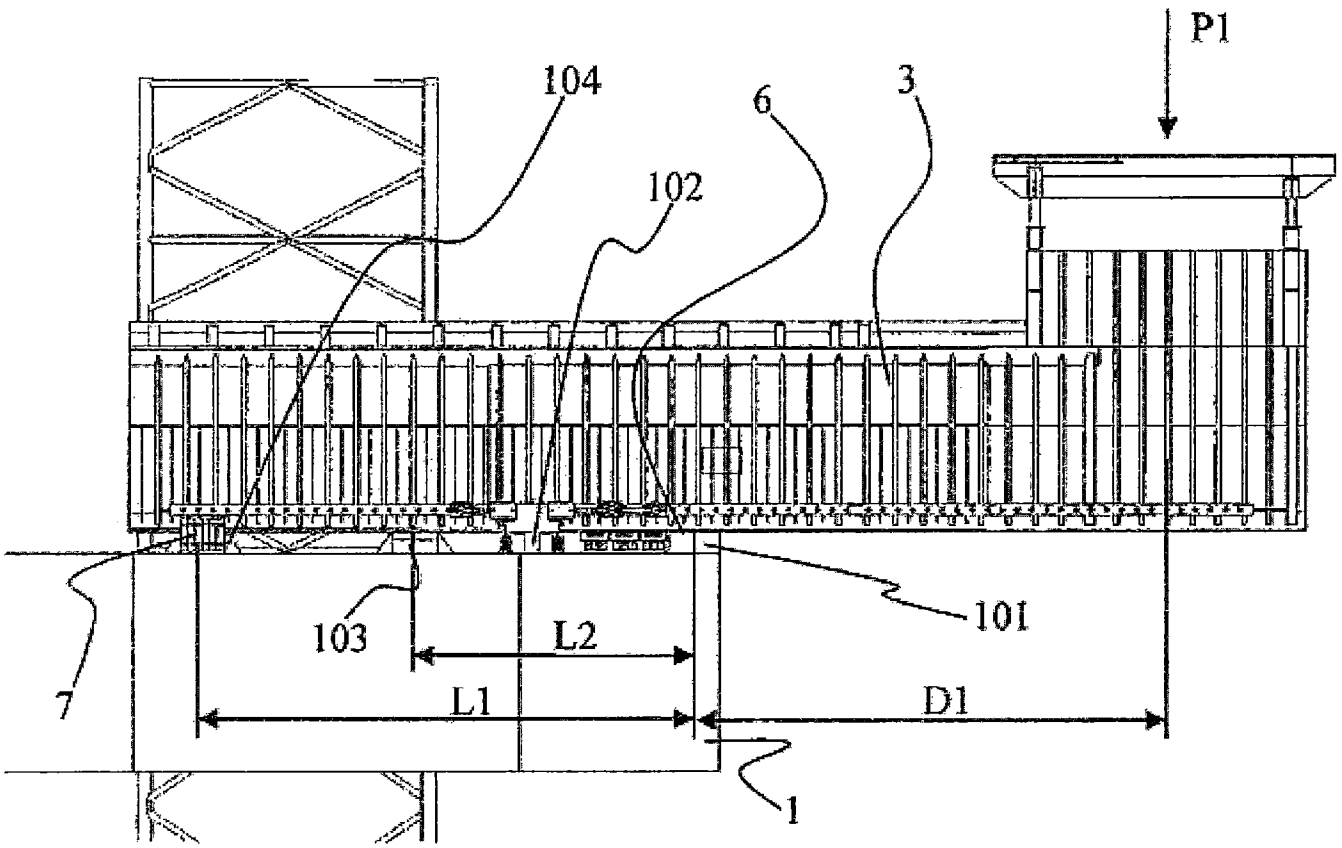
FIG. 9 is a profile view illustrating the versatile multipurpose JU with a cantilever being held-down at the FWD fixed cantilever hold-down modules.
Figure 10:
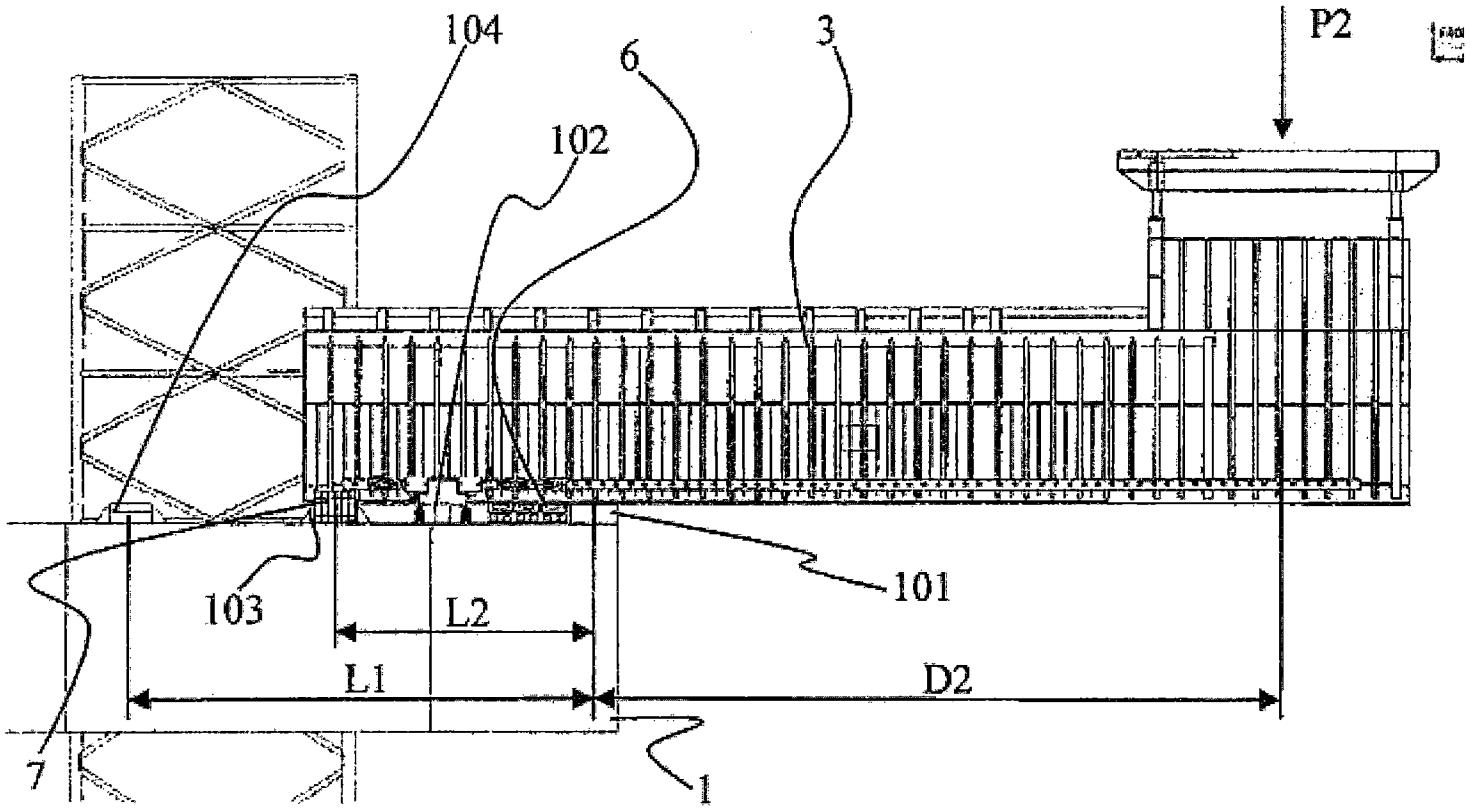
FIG. 10 is a profile view illustrating the versatile multipurpose JU with a cantilever being held-down at the AFT fixed cantilever hold-down modules.

FIG. 9 shows a profile view of the versatile multipurpose JU with a cantilever being held-down at the FWD fixed cantilever hold-down modules (104). The detachable passive hold-down devices 7 are mounted on the FWD fixed cantilever hold-down module 104, and hence, the cantilever 3 is tied down at a position with a distance L1 from transom. The maximum cantilever longitudinal skidding capacity in this case is D1 and the maximum load capacity for the cantilever is P1 in this case. FIG. 10 shows a profile view of the versatile multipurpose JU with a cantilever being held-down at the AFT fixed cantilever hold-down modules. In FIG. 10, the detachable passive hold-down devices 7 are removed from the FWD fixed cantilever hold-down modules 104 and installed onto the AFT fixed cantilever hold-down modules 103. So the cantilever 3 is tied down at a position with a distance L2 to transom. The ratio L1/L2 as shown in FIGS. 9 and 10 equals to 2 (this ratio can be any value according to actual designs). In this case, the cantilever maximum longitudinal skidding capacity becomes D2, which is D1+L1−L2. The total gain for longitudinal skidding capacity is L1-L2 when the detachable passive hold-down devices 7 is mounted on the AFT fixed cantilever hold-down modules 103 instead of the FWD fixed cantilever hold-down modules 104. On the other hand, the maximum load capacity for the cantilever in case shown in FIG. 10 is P2. P1/P2 equals to L1D2/L2D1. As L1/L2 equals to 2 and D2 equals to D1+L1−L2, P1/P2 equals to 2 (D1+L1−L2)/D1. P2 equals to D1/2(D1+L1−L2). It can be concluded that by having the configuration shown in FIG. 10, the total longitudinal skidding capacity increases to D1+L1−L2 while the maximum load capacity at maximum longitudinal skidding distance is reduced to D1/2(D1+L1−L2). The rollers 6 shown in the figure shall be optional and the system should be able to work with or without it. When it is installed, it should be as close as possible to the stern pad 101. Therefore, by selecting different pair of detachable passive hold-down devices 7 among 103*a*, 103*b*, 103*c*, 103*d* or 104*a*, 104*b*, 104*c* and 104*d*, the cantilever can obtain different maximum longitudinal skidding distance or achieve different maximum load capacity. It is to be noted that the hold-down device 7 is used for illustration in FIGS. 9 and 10; the hold-down device 7*a* can also be used.

The longitudinal skidding of the cantilever is achieved by the longitudinal skidding system 5 that has as pedestal with one end of hydraulic cylinders mounted, the pedestal is mounted on 102 which is fixed to the main deck. The other end of hydraulic cylinders is mounted with a claw type support, which has a locking pin inside. The locking pin interacts with the patterned holes drilled on skidding beams welded on side of the cantilever (the long beam with many patterned holes on side of cantilever shown in FIG. 9) so the cantilever can be pushed/pulled to skid by the skidding cylinders installed on 102, if 102 is combined with stern pad 101, the location of the longitudinal skidding system 5 will move to 101 as well.

The versatile multipurpose JU of the present subject matter can be employed in any jackup rig to provide a detachable cantilever so that the jackup rig can be employed for many purposes including drilling, accommodation, decommissioning, well intervention, and plug and abandonment (P&A). The detachable cantilever can have various designs: it can come with a drill floor and derrick with required load capacity (for normal drill, exploration drill, intervention and P&A); it can work without drilling floor but hold mud return, power and utilities to support modular rigs; it can even be attached with a modular rig on top (for intervention, P&A or exploration drill). The different designs of detachable cantilever can be installed on or removed from the JU freely depending on the job the JU has to handle. The JU can be setup to its optimized configurations for all abovementioned purposes with a few lifting on site, no hot-work (such as welding or flame cutting) required. If a drilling capable cantilever is installed on the JU, the JU can work as a norm drilling rig; if a cantilever capable of transferring utility power, fluid (including mud and cementing) and air to other platform, the JU become a support rig; if the support rig is installed with P&A equipment and the cantilever capable of handling mud return and transferring utility power, fluid (including mud and cementing) and air to modular rig on the platform, the JU becomes a P&A support etc. The function of the JU will basically not be limited by its cantilever in the present subject matter.

FIGS. 11-19 illustrate that the versatile multipurpose JU of the present subject matter can accommodate various designs of cantilevers with four working groups provided.

Figure 11:
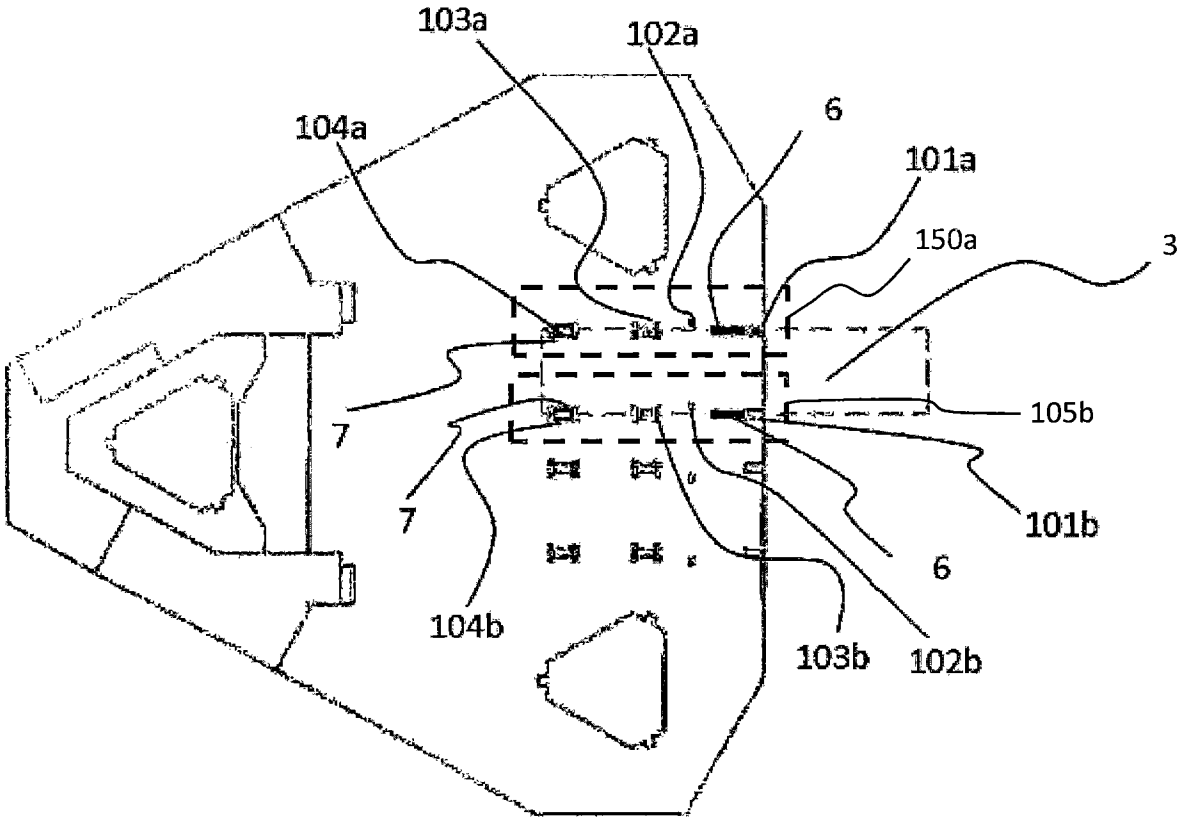
FIGS. 11-19 illustrate that the versatile multipurpose JU of the present subject matter can accommodate various designs of cantilevers with four working groups provided.

FIG. 11 shown the detachable cantilever utilizing longitudinal working groups 150*a* and 150*b* which allows for a narrow width having an offset from the center of the JU platform. In FIG. 11, the FWD fixed cantilever hold down modules 104*a* and 104*b* are used to provide a maximum load.

Figure 12:
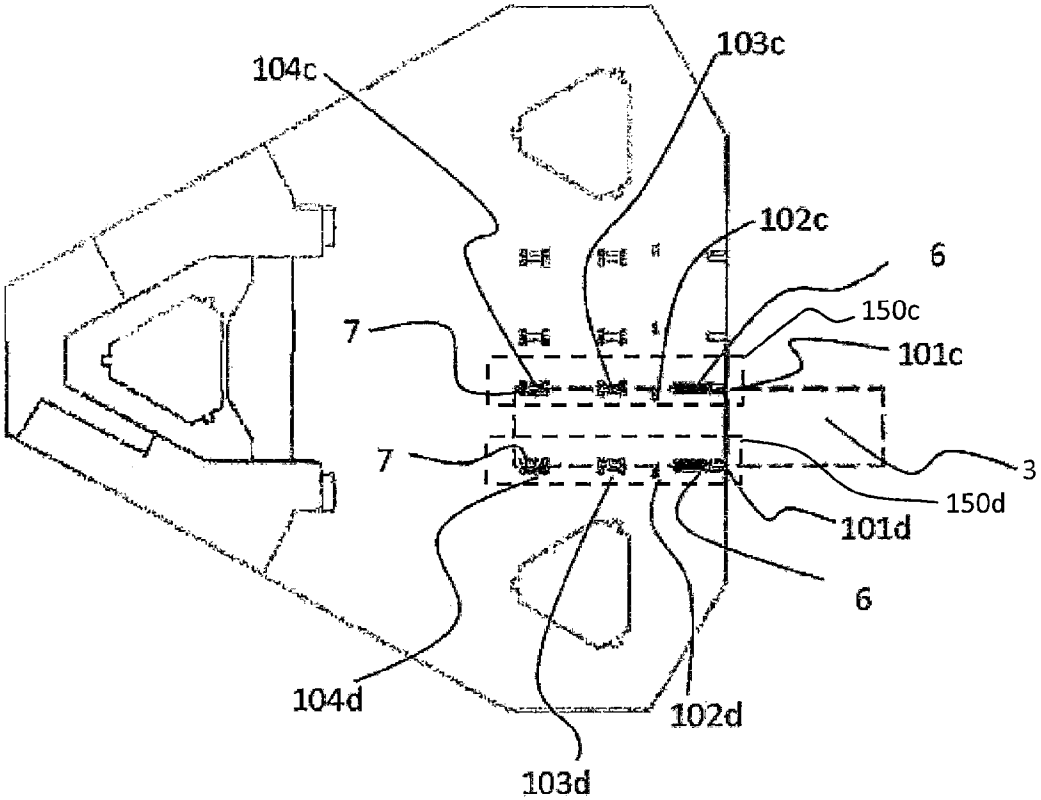

FIG. 12 shows the detachable cantilever utilizing longitudinal working groups 150*c* and 150*d* which also allows for a narrow width and offset from the center of the JU platform. In FIG. 12, the FWD fixed cantilever hold down modules 104*c* and 104*d* are used to provide a maximum load.

Figure 13:
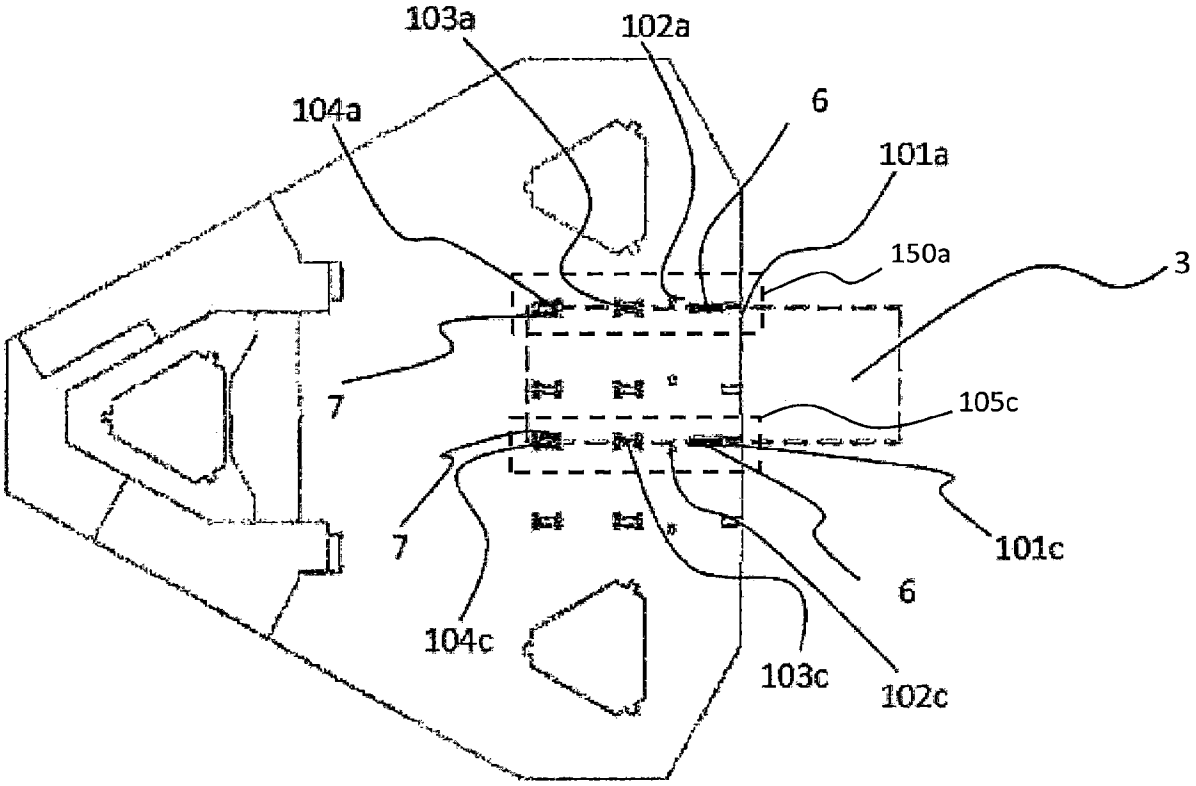
Figure 14:
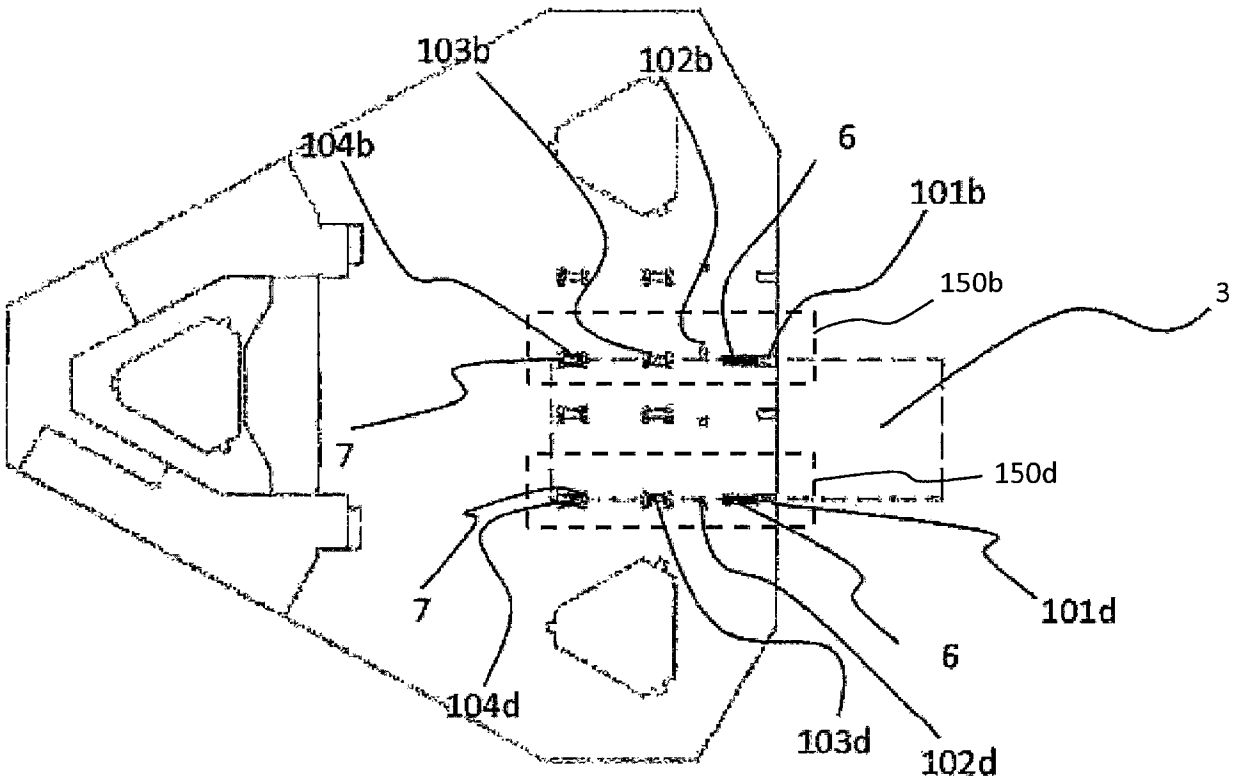
Figure 17:
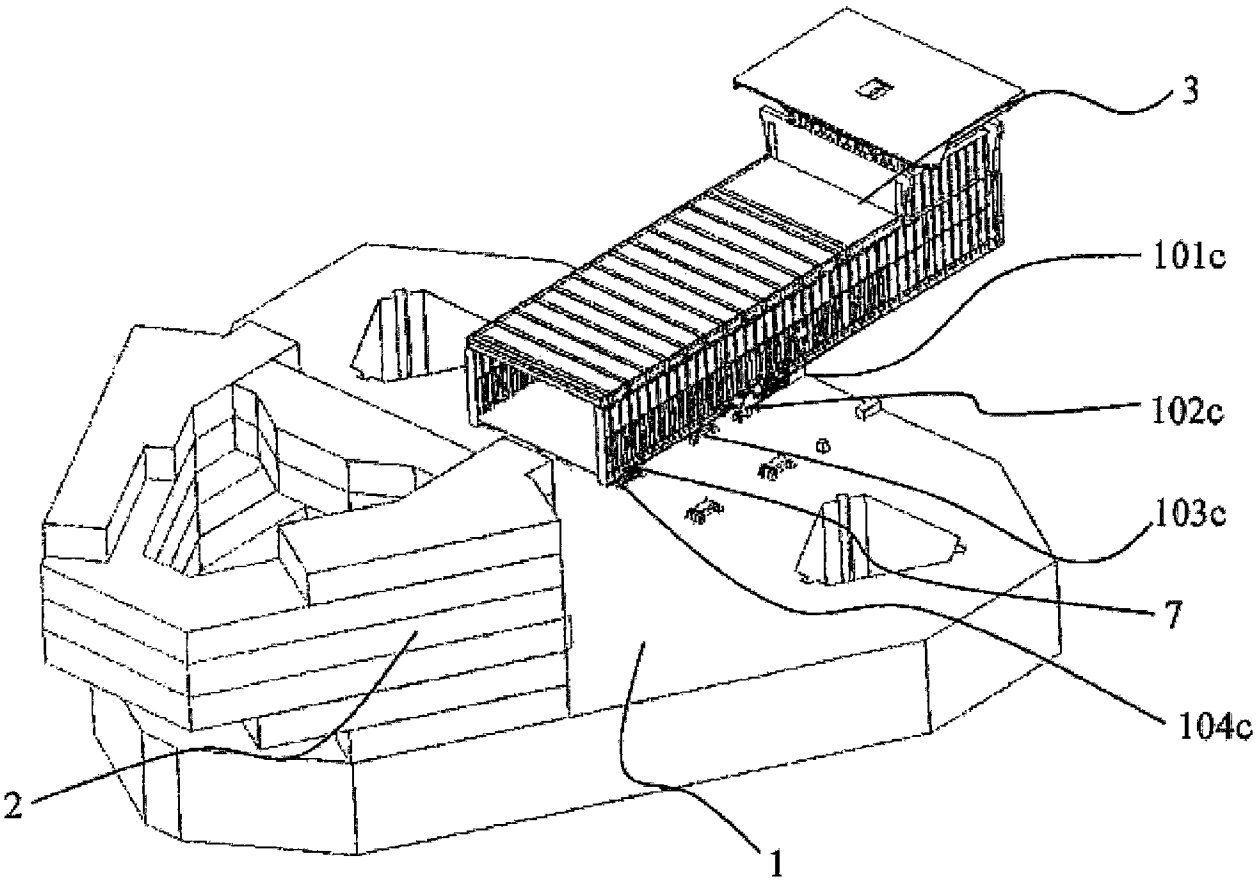
Figure 18:
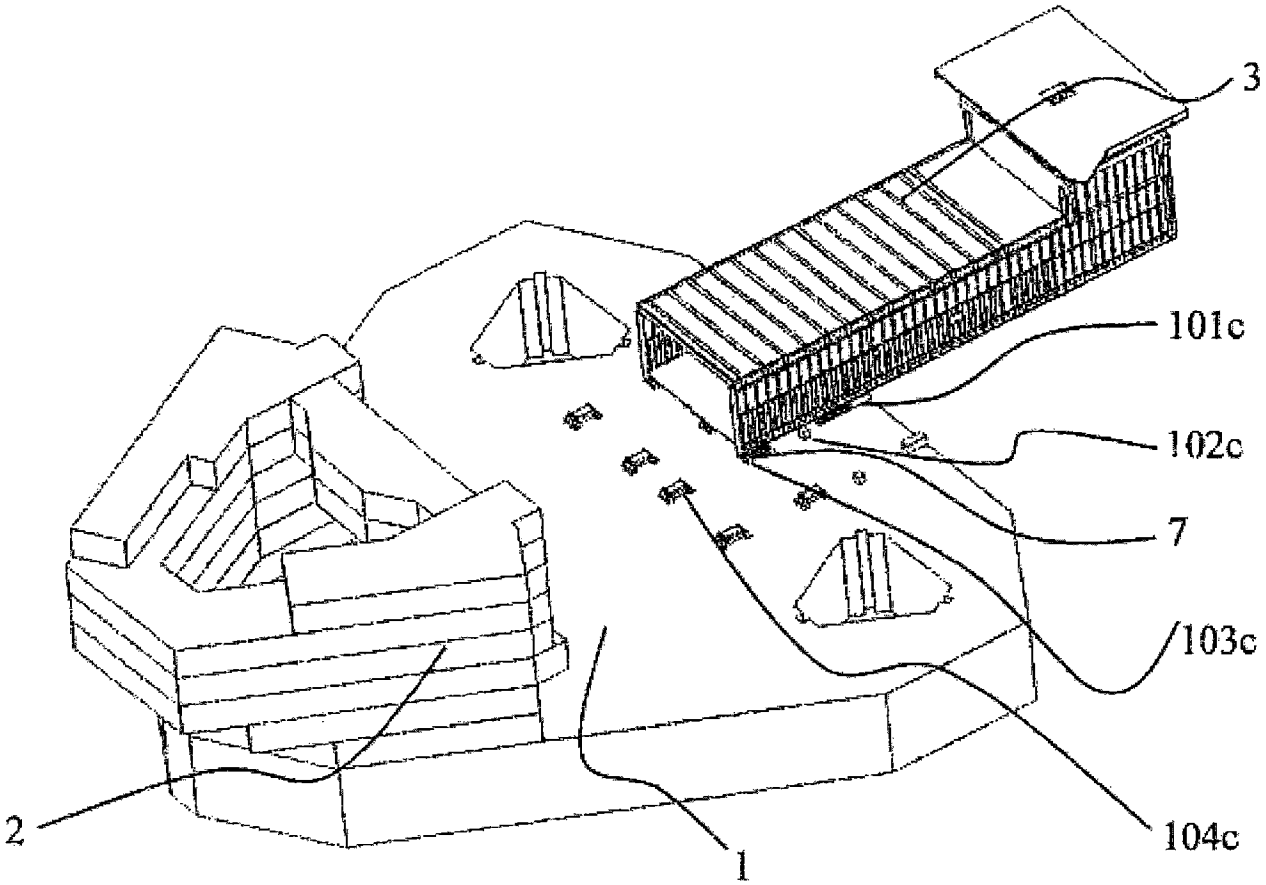
Figure 19:
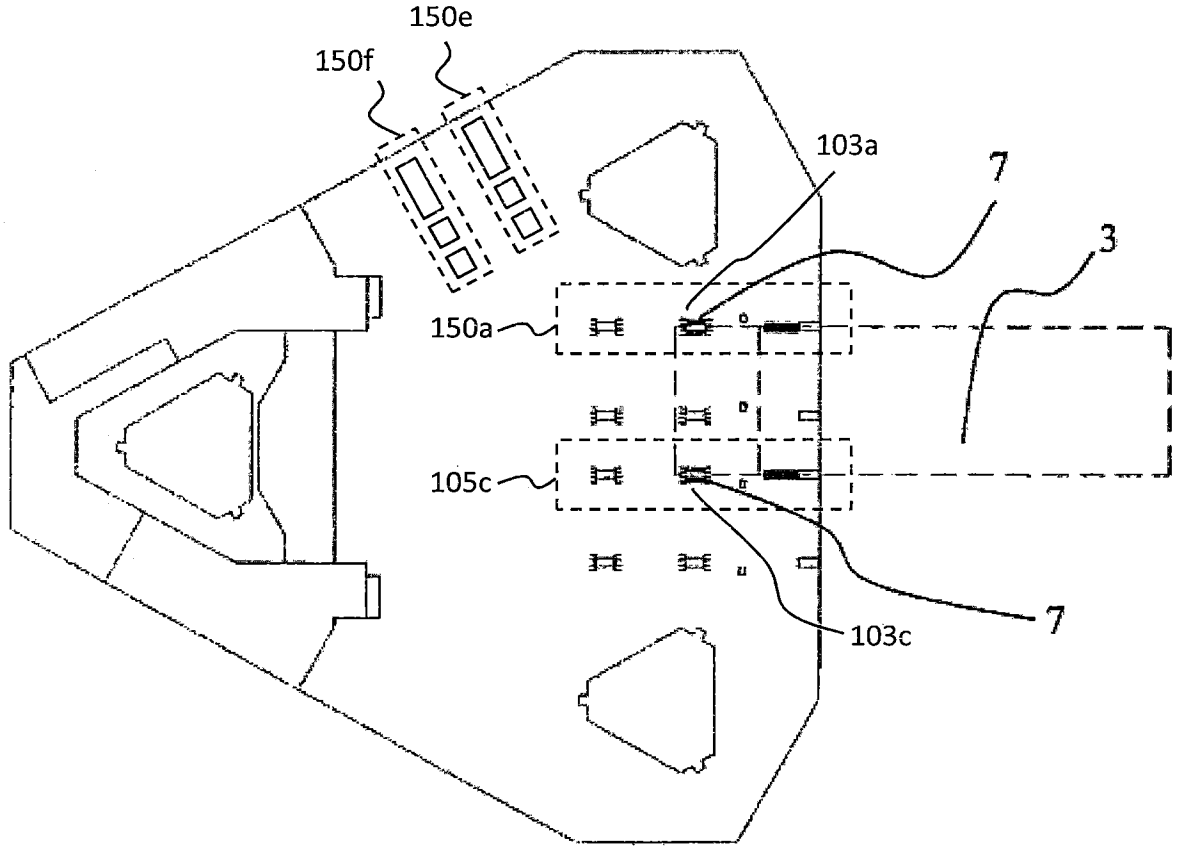

FIGS. 13, 17, 18 and 19 show the detachable cantilever utilizing longitudinal working groups 150*a* and 150*c*. FIGS. 13 and 17 shown the detachable cantilever 3 attached to the FWD fixed cantilever hold down modules 104*a* and 104*c*, while FIGS. 18 and 19 show the detachable cantilever 3 attached to the AFT fixed cantilever hold down modules 103*a* and 103*c*. FIG. 19 also shows parallel working groups 150*e* and 150*f* which are oblique to the working groups 150*a*-*d*. The additional longitudinal working groups may also be perpendicular to the other working groups and provide similar benefits.

Figure 15:
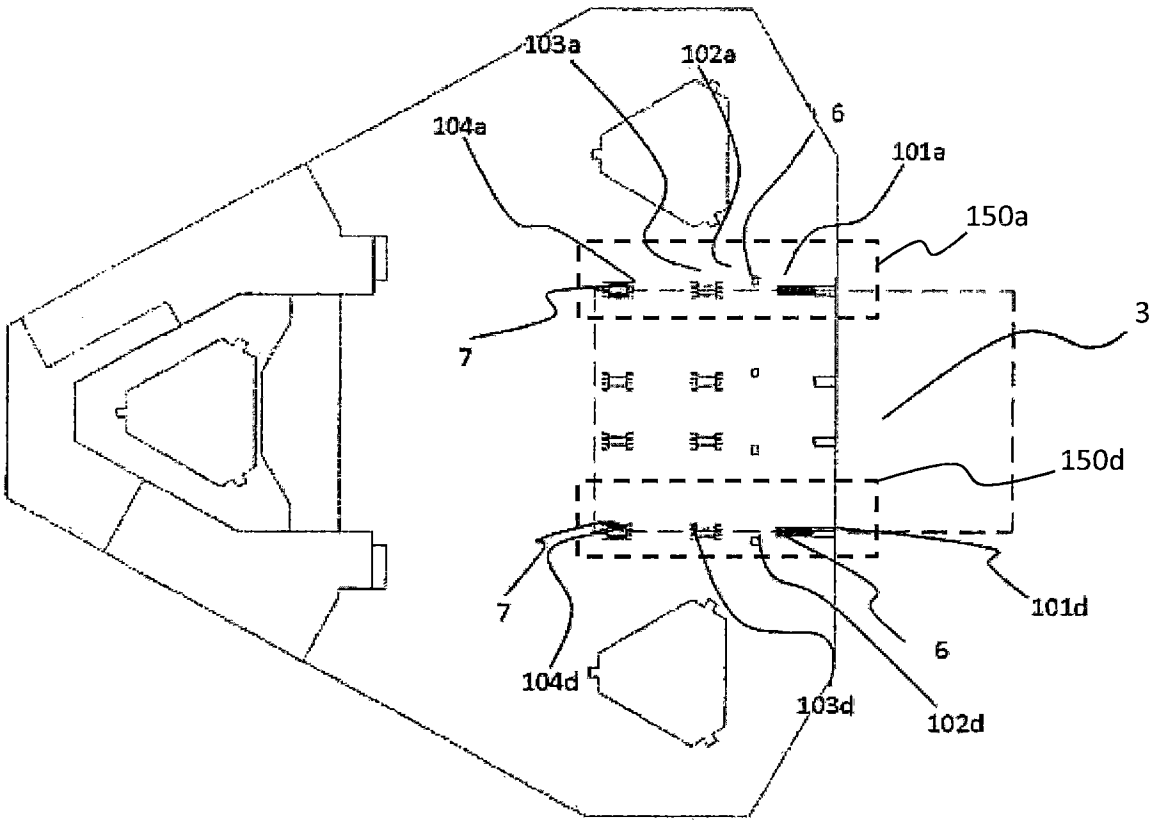
Figure 16:
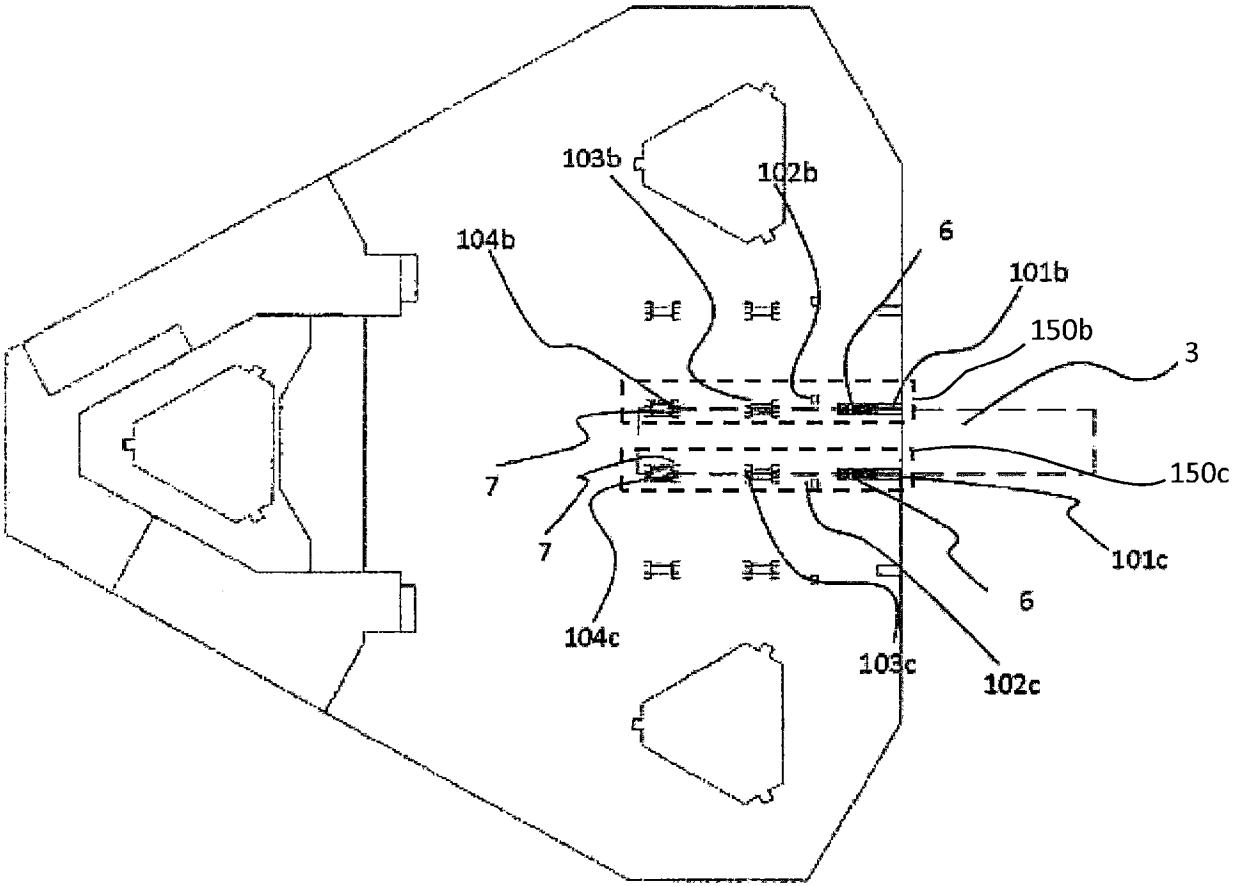

FIGS. 15 and 16 show the detachable cantilever 3 utilizing longitudinal working groups 150*a* and 150*d* for a maximum width and 150*b* and 150*c* for a minimum width on center of the platform. The distance between 150*a* and 150*b*, may be advantageously different from the distance between 150*b* and 150*c* as seen in FIGS. 11-19. Likewise, the different between 150*c* and 150*d* while not shown may also be different from either of the formerly mentioned distances. Preferably, the working groups are positioned with respect to each other to accommodate a plurality of the sizes commonly used for detachable cantilevers.

While preferred embodiments of the present subject matter have been described, it is to be understood that the embodiments described are illustrative only and that the scope of the subject matter is to be defined solely by the appended claims when accorded a full range of equivalence, many variations and modifications naturally occurring to those of skill in the art from a perusal hereof.

What is claimed is:

1. A versatile multipurpose jackup unit, comprising:

a hull with a top platform; and a configurable and detachable cantilever installation system comprising:

a first plurality of longitudinal working groups; wherein each longitudinal working group comprises a stern pad, and more than one fixed cantilever hold-down modules; wherein the stern pad is disposed at a transverse position along the transom of the top platform so that the stern pad, and fixed cantilever hold-down modules are sequentially aligned to form the longitudinal working group; and wherein each working groups is capable of accommodating one beam of a cantilever; and a plurality of detachable passive hold-down devices; wherein one detachable passive hold-down device is coupled with one fixed cantilever hold-down module in one longitudinal working group when the fixed cantilever hold-down modules and detachable passive hold-down devices are engaged with a cantilever;

a first subset of the first plurality of longitudinal working groups, each longitudinal working group in the first subset having at least one detachable passive hold-down device coupled with at least one fixed cantilever hold-down modules;

a second subset of the first plurality of longitudinal working groups, wherein each of the more than one fixed cantilever hold-down modules of each of the longitudinal working groups in the second subset without the detachable passive hold-down device.

2. The versatile multipurpose jackup unit of claim 1, further comprising a plurality of longitudinal skidding foundations for the skidding of the beam of cantilever, wherein each of plurality of the longitudinal skidding foundations is disposed between the stern pad and fixed cantilever hold-down modules in the longitudinal working group.

3. The versatile multipurpose jackup unit of claim 1, wherein the more than one fixed cantilever hold-down modules comprises at least one AFT fixed cantilever hold-down module, and at least one FWD fixed cantilever hold-down module.

4. The versatile multipurpose jackup unit of claim 1, wherein the stern pad has a main body, and two side flanges; wherein the bottom of the main body is permanently welded onto the top platform; wherein the main body has a top surface for bearing a compression load; and wherein the two side flanges are positioned on the two opposite sides in the main body and built close to the top surface so as to guide a cantilever skidding beam.

5. The versatile multipurpose jackup unit of claim 1, wherein the first plurality of longitudinal working groups comprises at least 3 longitudinal working groups.

6. The versatile multipurpose jackup unit of claim 1, wherein the first plurality of longitudinal working groups comprise at least three groups and wherein each of the first plurality of longitudinal working groups is in at least one pair with another of the first plurality of longitudinal working groups and each pair has a distance between the working groups that is different from each of the other pairs.

7. The versatile multipurpose jackup unit of claim 1, wherein the first plurality of longitudinal working groups are parallel to each other.

8. The versatile multipurpose jackup unit of claim 7, further comprising a second plurality of longitudinal working groups parallel to each other and are not parallel to the first plurality of longitudinal working groups.

9. The versatile multipurpose jackup unit of claim 8, wherein second plurality of longitudinal working groups are perpendicular to the first plurality of longitudinal working groups.

10. The versatile multipurpose jackup unit of claim 8, wherein second plurality of longitudinal working groups are oblique to the first plurality of longitudinal working groups.

11. A versatile multipurpose jackup unit, comprising:

a hull with a top platform; and a configurable and detachable cantilever installation system comprising:

a first plurality of longitudinal working groups; wherein each longitudinal working group comprises a stern pad, and more than one fixed cantilever hold-down modules; wherein the stern pad is disposed at a transverse position along the transom of the top platform so that the stern pad, and fixed cantilever hold-down modules are sequentially aligned to form the longitudinal working group; and wherein each working groups is capable of accommodating one beam of a cantilever; and a plurality of detachable passive hold-down devices; wherein one detachable passive hold-down device is coupled with one fixed cantilever hold-down module in one longitudinal working group when the fixed cantilever hold-down modules and detachable passive hold-down devices are engaged with a cantilever;

wherein the fixed cantilever hold-down module comprises a hold-down body and two side stoppers that are coupled to the two ends of the hold-down body; wherein the hold-down body and two side stoppers are permanently fixed onto the top platform; and wherein the hold-down body has an engaging lip at its upper portion; and wherein the detachable passive hold-down device has a U-shaped recess formed at the center of its inner surface so as to form an upper engaging surface and a lower engaging surface;

so that when two of the detachable passive hold-down devices are engaged with the hold-down body, the lower engaging surface is in contact with the engaging lip and the upper engaging surface with the upper surface of a cantilever skidding beam when the detachable passive hold-down devices are installed.

12. A versatile multipurpose jackup unit, comprising:

a hull with a top platform; and a configurable and detachable cantilever installation system comprising:

a first plurality of longitudinal working groups; wherein each longitudinal working group comprises a stern pad, and more than one fixed cantilever hold-down modules; wherein the stern pad is disposed at a transverse position along the transom of the top platform so that the stern pad, and fixed cantilever hold-down modules are sequentially aligned to form the longitudinal working group; and wherein each working groups is capable of accommodating one beam of a cantilever; and a plurality of detachable passive hold-down devices; wherein one detachable passive hold-down device is coupled with one fixed cantilever hold-down module in one longitudinal working group when the fixed cantilever hold-down modules and detachable passive hold-down devices are engaged with a cantilever;

wherein the fixed cantilever hold-down module has an E-shaped configuration; wherein the fixed cantilever hold-down module has a cantilever support surface, two end supports and a middle bridge for supporting the cantilever support surface, two pairs of upward cantilever guiding protrusions of which each is disposed at one corner of the fixed cantilever hold-down module, a plurality of locking pins, and a plurality of locking pin receiving holes located at the two end supports and middle bridge for receiving the locking pins; and the detachable hold-down device having a recess formed at the center of its inner surface so as to form at least one upper engaging surface and a locking pin receiving hole located at its bottom half for receiving the locking pins;

so that when the fixed cantilever hold-down module and detachable hold-down device are assembled, the detachable hold-down device can pivotedly rotate between a disengaged position in which the detachable hold-down device is in a substantially horizontal orientation to an engaged position in which the detachable hold-down device is in a substantially vertical orientation.

13. The versatile multipurpose jackup unit of claim 12, wherein the locking pins are two pairs, and each side of the two end supports and middle bridge has one locking pin receiving hole for receiving one locking pin.

14. The versatile multipurpose jackup unit of claim 12, further comprising a retaining hole in each pair of the upward cantilever guiding protrusions and a second retaining hole in the detachable hold down device, wherein the retaining hole and the second retaining hole align when the detachable hold down device is in the engaged position.

15. The versatile multipurpose jackup unit of claim 14, further comprising a retaining pin received in the first and second retaining holes preventing rotation of the detachable hold down device from the engaged position.

16. A versatile multipurpose jackup unit, comprising:

a hull with a top platform; and a configurable and detachable cantilever installation system comprising:

a first plurality of longitudinal working groups; wherein each longitudinal working group comprises a stern pad, and more than one fixed cantilever hold-down modules; wherein the stern pad is disposed at a transverse position along the transom of the top platform so that the stern pad, and fixed cantilever hold-down modules are sequentially aligned to form the longitudinal working group; and wherein each working groups is capable of accommodating one beam of a cantilever; and a plurality of detachable passive hold-down devices; wherein one detachable passive hold-down device is coupled with one fixed cantilever hold-down module in one longitudinal working group when the fixed cantilever hold-down modules and detachable passive hold-down devices are engaged with a cantilever, further comprising a retaining hole in each of a pair of upward cantilever guiding protrusions and a second retaining hole in the detachable passive hold down device, wherein the retaining hole and the second retaining hole align when the detachable hold down device is in the engaged position.

17. The versatile multipurpose jackup unit of claim 16, further comprising a retaining pin received in the first and second retaining holes preventing rotation of the detachable passive hold down device from the engaged position.

18. The versatile multipurpose jackup unit of claim 17, wherein the retaining pin is selected from the group consisting of bolt, key, rod, rivet, screw, clip, hitch pin, lynch pin, safety pin and cotter pin.

* * * * *